US010875164B2

(12) United States Patent
Whitmore

(10) Patent No.: US 10,875,164 B2
(45) Date of Patent: Dec. 29, 2020

(54) METHOD AND TOOL FOR ENGAGING AND DISENGAGING INSULATOR COTTER KEYS

(71) Applicant: Jonathan Whitmore, Cypress, FL (US)

(72) Inventor: Jonathan Whitmore, Cypress, FL (US)

( * ) Notice: Subject to any disclaimer, the term of this patent is extended or adjusted under 35 U.S.C. 154(b) by 250 days.

(21) Appl. No.: 16/125,935

(22) Filed: Sep. 10, 2018

(65) Prior Publication Data

US 2019/0099867 A1 Apr. 4, 2019

Related U.S. Application Data

(60) Provisional application No. 62/567,825, filed on Oct. 4, 2017.

(51) Int. Cl.
*B25B 27/08* (2006.01)
*B25B 27/20* (2006.01)

(52) U.S. Cl.
CPC ..... *B25B 27/08* (2013.01); *B25B 27/20* (2013.01)

(58) Field of Classification Search
CPC ..... B25B 27/08; B25B 27/20
See application file for complete search history.

(56) References Cited

U.S. PATENT DOCUMENTS 1,302,287 A * 4/1919 Berg ..... B25B 27/08 29/247
1,403,919 A * 1/1922 Seppmann ..... B25B 27/08 29/247
1,514,117 A * 11/1924 Wilder ..... B25B 27/08 29/247
1,535,012 A * 4/1925 Zeller ..... B25B 27/08 29/247
1,597,159 A * 8/1926 Johnson ..... B25B 27/08 29/247
1,610,969 A * 12/1926 Robertson ..... B25B 27/08 29/247
1,621,576 A * 3/1927 Besancon ..... B25B 27/08 29/248
1,707,842 A * 4/1929 Buckle ..... B25B 27/08 29/247
1,812,682 A * 6/1931 Buckle ..... B25B 27/08 29/248
2,884,690 A * 5/1959 Becker, Jr. ..... B25B 27/08 29/247
3,153,357 A * 10/1964 Decker ..... B25B 27/08 72/409.13

(Continued)

*Primary Examiner* — Bayan Salone
(74) *Attorney, Agent, or Firm* — The Petruzzi Law Firm; James D. Petruzzi

(57) ABSTRACT

A tool to remove or insert cotter keys in insulator bells having an L-shaped handle, with at least one depression on a generally flat butt end surface of the handle, a generally cylindrical rigid L-shaped member extending from the distal portion of the handle that terminates at a distal end in a second generally cylindrical tab having a smaller cross section than that of the rigid member. The method involves leveraging the member on an insulator cap while the tab is in a cotter key or for insertion, pressing the handle butt end at a depression against the key. The handle may be formed of two halves, be a unified body of synthetic material, be pliable and have an ergonomic shape, and the tab can be any of a variety of cross sectional shapes. The handle and extension may also be integrally formed and be made of similar materials.

20 Claims, 5 Drawing Sheets

(56) References Cited

U.S. PATENT DOCUMENTS

| | | | | | |
|---|---|---|---|---|---|
| 4,277,872 | A | * | 7/1981 | Lewis | B25B 27/08 29/229 |
| 5,245,737 | A | * | 9/1993 | Perea | B25B 27/20 29/247 |
| 5,557,832 | A | * | 9/1996 | Vanden Brook | B25B 27/08 29/229 |
| 5,819,385 | A | * | 10/1998 | Klaptchuk | B25B 13/48 29/213.1 |
| D744,422 | S | * | 12/2015 | Landry | D13/133 |

* cited by examiner

METHOD AND TOOL FOR ENGAGING AND DISENGAGING INSULATOR COTTER KEYS

CROSS REFERENCE TO RELATED APPLICATIONS

This U.S. utility patent application claims the benefit of priority of provisional application Ser. No. 62/567,825 filed on Oct. 4, 2017 entitled "Method and Tool for Engaging and Disengaging Insulator Cotter Keys" which is incorporated herein by reference as if fully set forth herein.

BACKGROUND OF THE INVENTION

The present invention relates to tools, and more particularly to a method and tool for engaging and disengaging insulator cotter keys.

Prior solutions to removal of cotter keys in insulator strings primarily involved wedging a screwdriver or other sharp object into the space between the insulator bells and support cap to remove the cotter key. Typically the insulator material is glass, ceramic, or fortified glass. This method often resulted in the insulator breaking which creates a dangerous situation and results in a waste of materials. Insertion, on the other hand, of the cotter key for engagement of the bell to one another in a string was often accomplished with a hammer and screwdriver or other sharp object being pounded against the cap and insulator, also causing damage or breakage. In some cases, the insulator material can explode when it breaks further endangering the operator.

These prior solutions and methods suffered from a variety of problems and failed to achieve a consistent and workmanlike removal and reengagement of the cotter key. Further, it failed to provide the workman with a convenient tool for easy and efficient removal and reengagement of the cotter key.

BRIEF SUMMARY OF THE INVENTION

A primary advantage of the invention is to provide a tool and method of operation for easy removal of a cotter key in an insulator string.

Another advantage of the invention is to provide a tool and method that permits easy reinstallation or engagement of a cotter key in an insulator string.

Yet another advantage of the invention is to provide an easily carried tool for use by a workman in the field.

Still yet another advantage of the invention is to provide an easily manufactured and stable tool for an operator to use.

In accordance with a preferred embodiment of the present invention a tool is shown having an ergonomic handle, with a metallic extension terminating in an L-shaped end having on its distal end an inset circular point for engagement under a cotter key that is situated in an insulator bell. The tool permits leveraged pressure to be applied to the cotter key to disengage it sufficiently to permit removal of the bell from the string. The tool may also be used by applying its handle against the inside rim of the insulator and pressuring the cotter key back into full engagement. With larger insulators a hammer may be used to apply additional pressure to engage the cotter key. The tool may be carried by the workman for ease of use.

In accordance with another embodiment of the invention, there is shown a tool for a user to remove or insert cotter keys in insulator bells having an L-shaped body having a first and second portion each axially symmetric, with at least one depression on a generally flat butt end surface of a proximal end of the L-shaped body, a generally cylindrical rigid member extending from the distal portion of the L-shaped body fixedly attached to the body, and the generally cylindrical rigid member being L-shaped that terminates at a distal end in a second generally cylindrical tab having a smaller cross section than the cross section of the rigid member.

In accordance with another preferred embodiment of the invention there is shown a tool for a user to remove or insert cotter keys having an axially symmetric body with at least one depression in a generally flat butt end surface of a proximal end of the body, the body having an extended proximal end with a generally cylindrical cross sectional L-shaped rigid member extending from the distal portion of the body fixedly inserted into a cavity in the body, and a tab extended from the distal end of the rigid member having a generally cylindrical cross sectional shape.

In accordance with yet another preferred embodiment of the invention there is shown a method for removing a cotter key from a bell in an insulator string using a tool having the steps of grasping an L-shaped body having a first and second portion each axially symmetric and a generally cylindrical L-shaped extension distal from the handle, inserting a smaller extension at the distal end of the L-shaped extension into a cotter key, leveraging the bend in the L-shaped cylindrical extension against an insulator bell, pulling upward the generally cylindrical L-shaped rigid member having its distal end terminated in a second generally cylindrical shorter portion having a smaller cross section than the cross section of the longer portion of the member while inserted into the cotter key in the insulator bell thereby permitting removal of the bell from an insulator string.

Other objects and advantages will become apparent from the following descriptions, taken in connection with the accompanying drawings, wherein, by way of illustration and example, preferred embodiments of the present invention are disclosed.

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

The drawings constitute a part of this specification and include exemplary embodiments to the invention, which may be embodied in various forms. It is to be understood that in some instances various aspects of the invention may be shown exaggerated or enlarged to facilitate an understanding of the invention.

Figure 1:
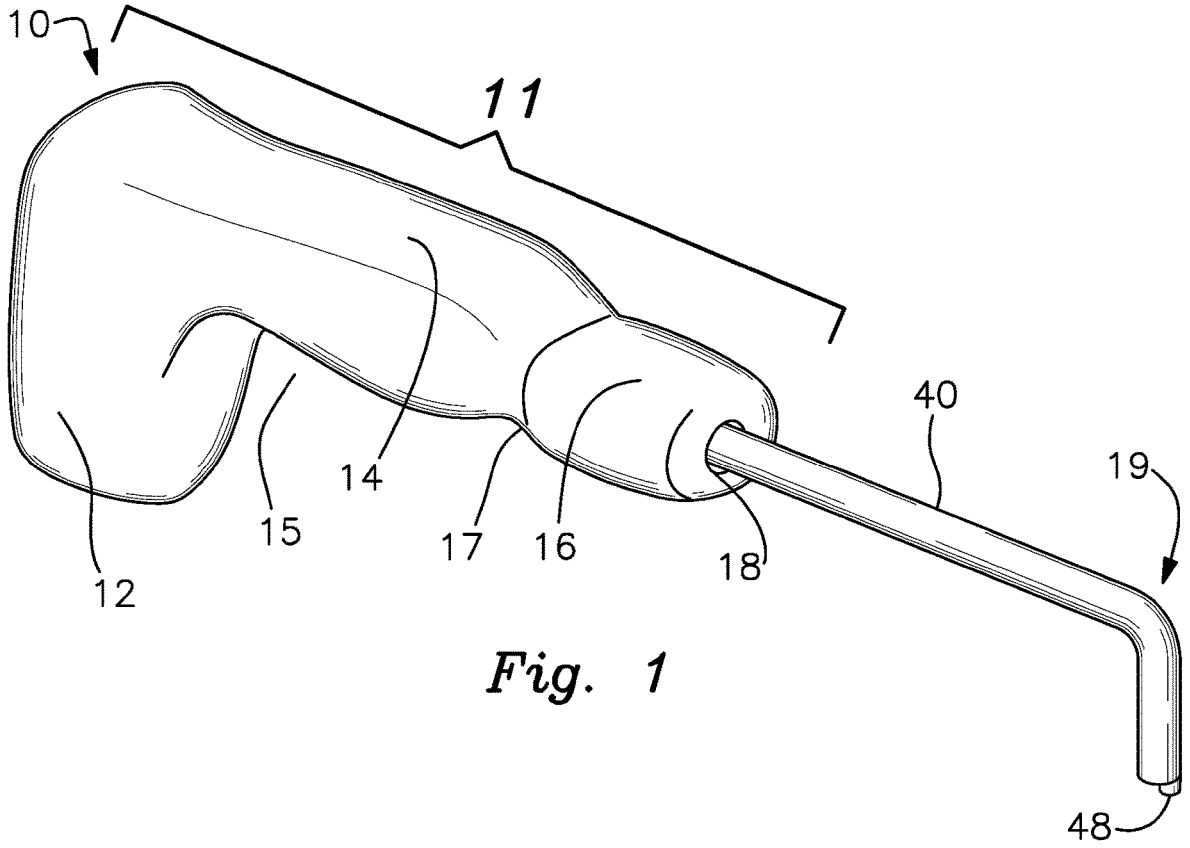
FIG. 1 is a perspective view of the tool having an extension according to a preferred embodiment of the invention.
Figure 2:
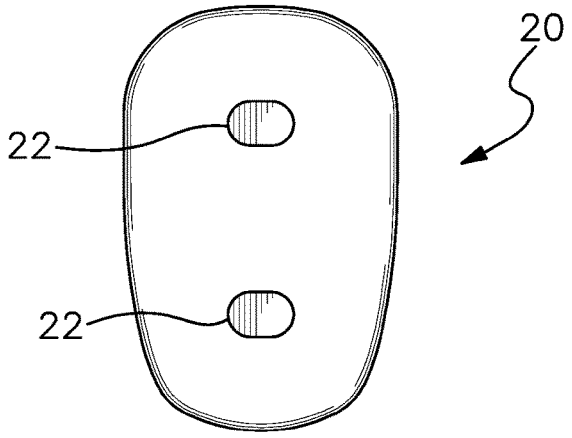
FIG. 2 is an elevation view of the proximal end of a handle of the tool according to a preferred embodiment of the invention.

Turning now to FIG. 1 there is shown a perspective view of tool 10 having a handle or body 11 and extension 40 in accordance with a preferred embodiment of the invention. Tool 10 is comprised of L-shaped handle 11 having first butt end portion 12 with butt end face 20 as shown in FIG. 2. Handle 11 has an extended portion from butt end portion 12 comprised of medial section 14 and distal portion 16. In a preferred embodiment, there may be a tapered section 17 between medial section 14 and distal portion 16. Handle 11 may be ergonomically configured in a variety of ways that are best suited to gripping by the hand, including additional indentations for finger placement on either medial section 14, distal portion 16 or a combination of both.

Handle 11 may be a relatively rigid material and may be manufactured by any of a number of known processes, including molding of plastic, machining of various materials, or if made of wood may be lathed or carved. In a preferred embodiment, handle 11 is made of material that does not conduct electricity and isolates the operator from the extension 40 which may typically be made of a rigid metal.

Extending from opening 18 in distal portion 16 in handle 11 is extension 40 that is preferably a metallic, generally cylindrical shape having an L-shaped extension 19 on the end, which in turn has a rounded smaller extension or tab 48 further described below. Generally cylindrical as used in this disclosure may be of any of a variety of polygonal shapes extended along an axis, including, but not limited to having a cross section of a circle, square, rectangle, oval, diamond or parallelogram. Smaller extension or tab 48 may be of any of a variety of cylindrical shapes although a smooth outer surface such as a circle, oval or ellipse is preferred. A squared extension or tab may also be desirable in certain cases.

Preferably, handle 11 has a radius of curvature 15 on the inside of the L-shaped portion that is approximately one inch. This facilitates insertion of the L-shaped handle under an insulator glass to provide leverage when re-inserting the cotter key into the cap and makes the tool easy to use by an operator's hand. Handle or body 11 may be formed of two symmetrical portions that are joined together by fusing or other molding techniques around extension 48. Alternatively, extension 48 may be inserted into handle 11 by threading, bolts, welding, glue or any of a variety of commonly known techniques in the field.

Turning to FIG. 2 there is shown an elevation view of butt end 12 of handle 11 having face 20 with depressions 22. Each depression is configured to approximate the area encompassed by the cotter key head being removed with the tool. Two notches are shown for handling insertion of the cotter key, although in practice only one is used in operation. The depressions or notches may preferably be shaped in a football or almond shape intended to fit the general outline of the cotter key and prevent it from shifting or sliding while pressure is applied downward for insertion as more fully described below.

Figure 3:
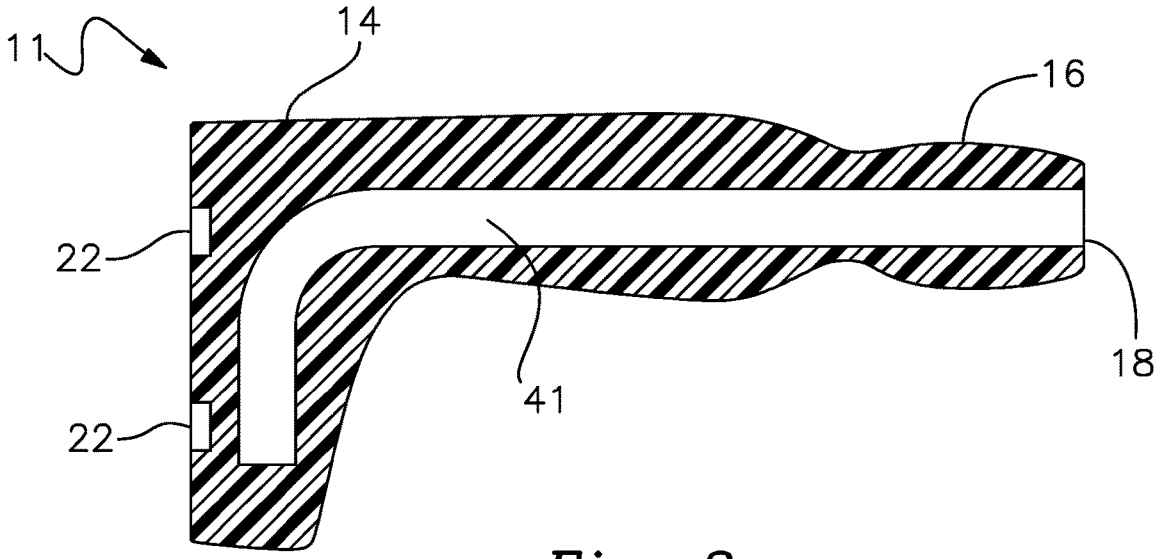
FIG. 3 is a cross sectional side view of a handle according to a preferred embodiment of the invention.
Figure 4:
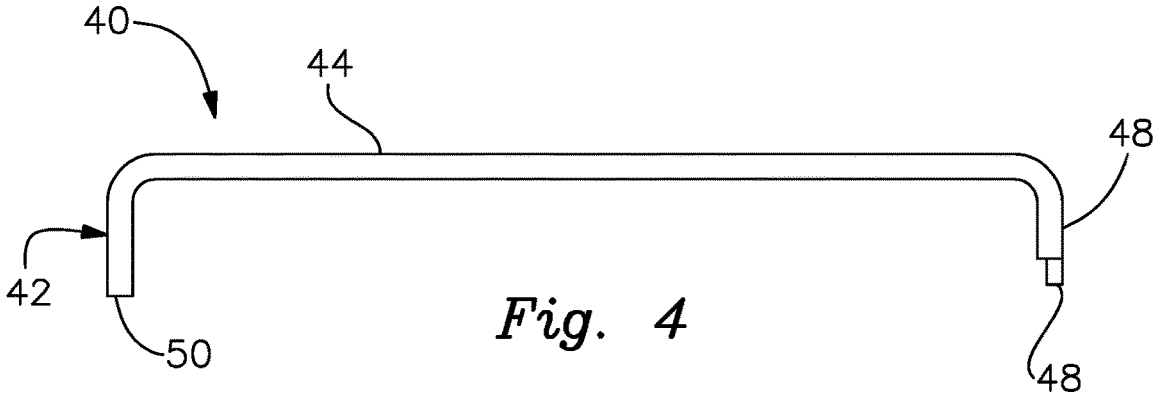
FIG. 4 is a side elevation view of the extension for the tool according to a preferred embodiment of the invention.

Turning to FIG. 3 there is shown a cross sectional view of handle 11 with pocket 41 for insertion or placement of extension 44 depicted in FIG. 4. Extension 44 may be integrally molded into handle 11, or be inserted between two or more pieces that together form handle 11, or inserted and fixed in any of a variety of manners as previously mentioned. In certain embodiments, handle 11 and extension 48 may be made of the same material or formed integrally of two materials so long as the extension has sufficient rigidity to work in the intended manner.

Turning to FIG. 4 there is shown a side elevation view of extension 44 having an L-shaped proximal end 42 and an L-shaped distal end 46. Proximal end 42 terminates in end 50 whereas distal end 46 terminates at extension 48 and projected from end 52 depicted in FIG. 5. A feature of extension 48 is that in a preferred embodiment, it is a cylindrical shape similar to the cylindrical shape of extension 44, but smaller in cross sectional size and offset from the axial center of distal end 46. Extension 48 is thus sticking outward from distal end 46 but having a different central axis. In other words, in a preferred embodiment, the axial center of extension 48 and axial center of distal end 46 are not concentric.

Figure 5:
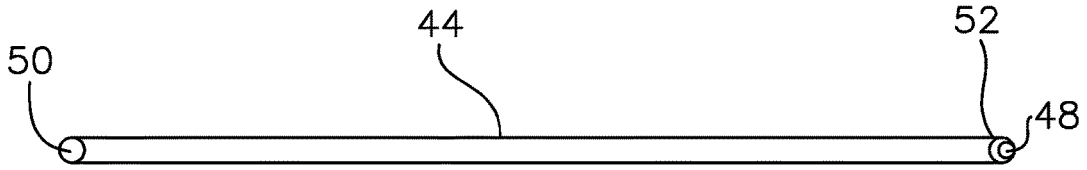
FIG. 5 is a bottom elevation view of the extension for the tool according to a preferred embodiment of the invention.

Turning to FIG. 5 there is shown a bottom plan view of extension 44 having end 50 on proximal end 42 and extension 48 on end 52 of distal end 46. In one embodiment, one edge of extension 48 may be positioned tangentially on the inner edge of the cross section of end 52 as shown in FIG. 5. As is readily seen in FIG. 5, the extension 48 is itself a small cylindrical member that may be machined from the larger cylindrical extension that provides a base for the extension 48.

Figure 6:
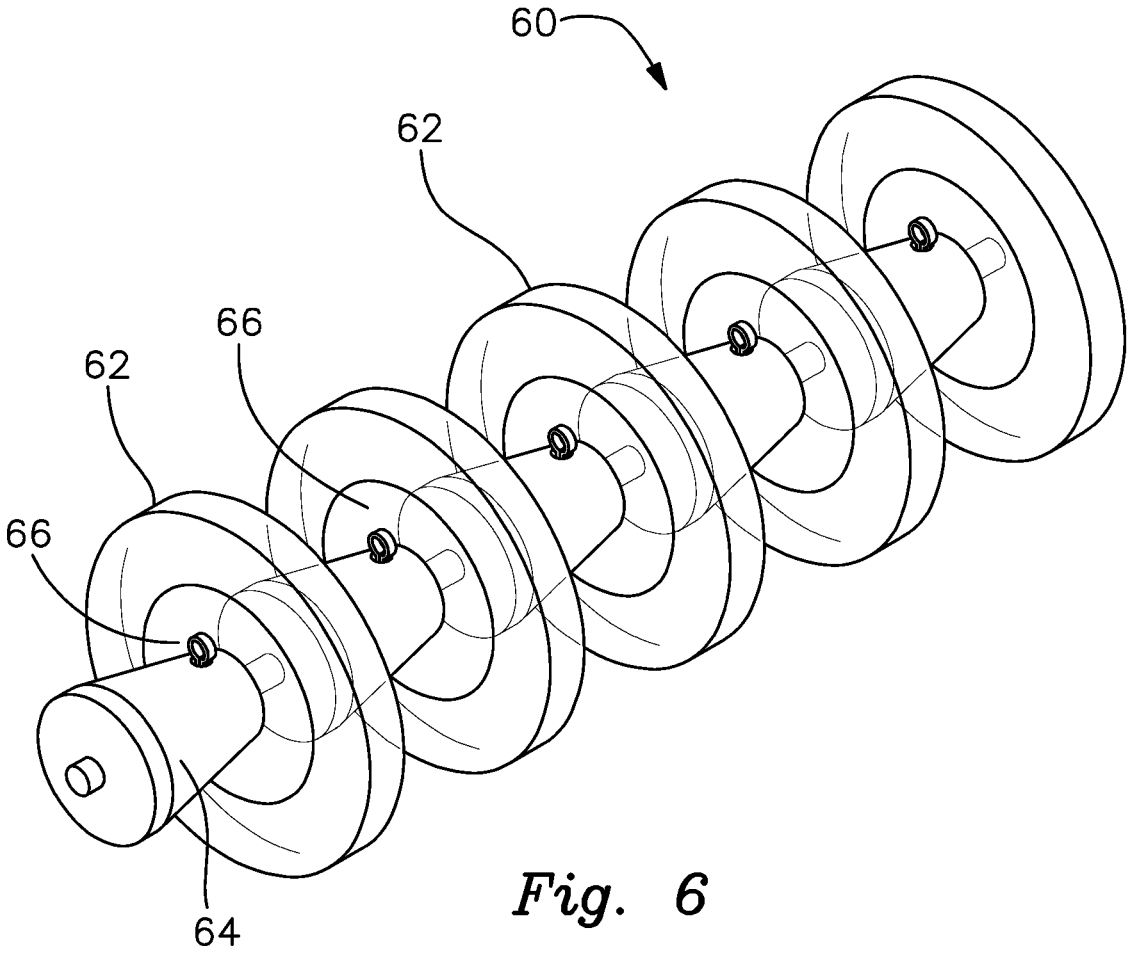
FIG. 6 is a perspective view of an insulator string with cotter keys.

Turning to FIG. 6 there is shown a perspective view of an insulator string 60 with glass insulators 62 and cotter keys 66. Each insulator is comprised of a cap or housing 64 and insulator ring 62 that are interconnected one into the other with stable engagement created by the cotter key 66 when fully inserted into the cap of the adjacent insulator. These strings are configured using conventional arrangements of several glass insulators and may be as many as desired or needed. The insulator ring may be of other materials such as glass or ceramic as such does not impact the operation of the tool of this invention.

Figure 7:
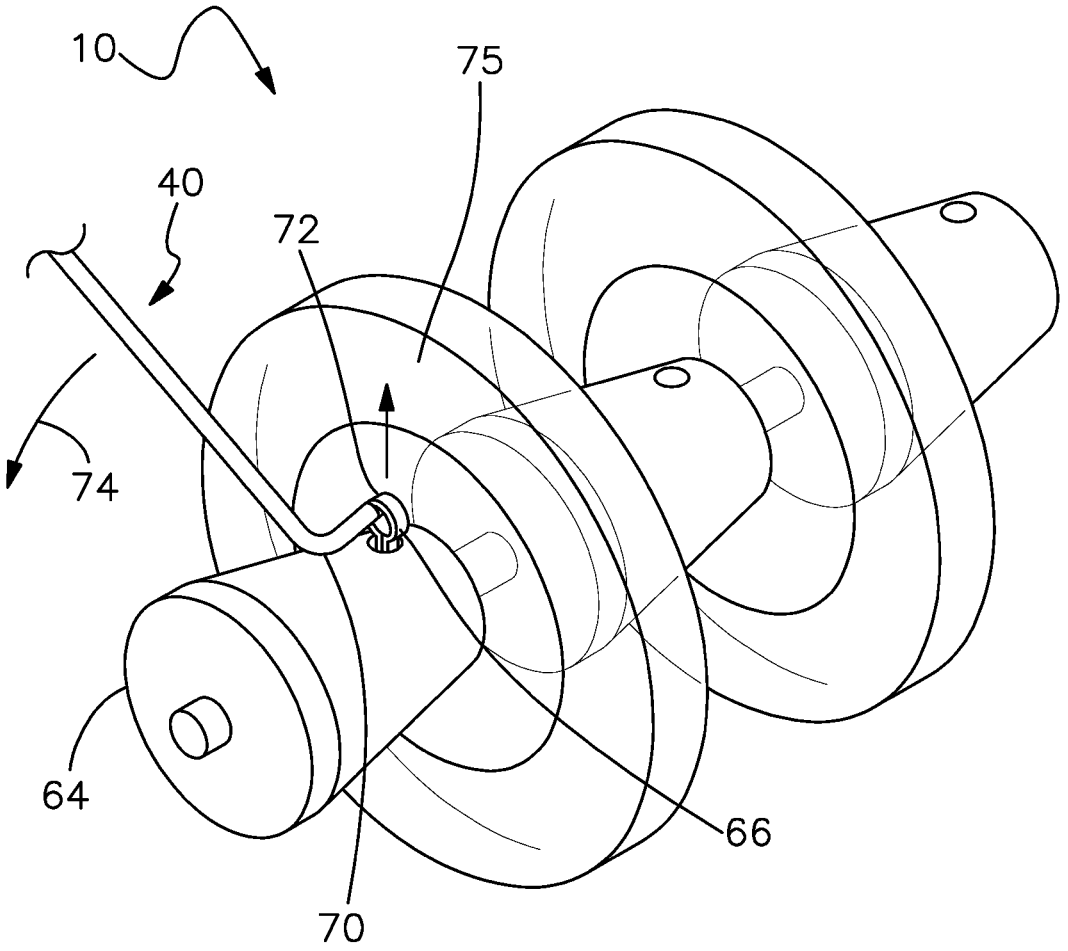
FIG. 7 is a perspective view of the distal end of the tool inserted into a cotter key for removal showing a method according to a preferred embodiment of the invention.

Turning to FIG. 7 there is shown a perspective view of the distal extension of tool 10 in operation to remove cotter key 66. In operation, the operator positions tool 10 at the L-shaped extension 40 having bend 70 positioned in contact with housing 64. While at the same time that bend 70 is in contact with housing 64, distal end 72 having smaller extension 48 as show in FIG. 4 is positioned into cotter key 66. By leveraging tool 10 in outward direction 74 away from the glass ring, and pivoting bend 70 on housing 64, tool 10 pulls up cotter key 66 in direction 75, thereby disengaging cotter 66 from the adjacent insulator housing. Cotter key 66 does not have to be removed, rather in a typical configuration it is only necessary to move it partially upward to permit freeing housing 64 from the adjacent insulator housing. The L-shaped curve at extension 40 is used to provide leverage against the cap or housing to permit an operator to quickly apply pressure on the cotter key and pull it out of engagement releasing the cap from the pin of another bell.

Figure 8:
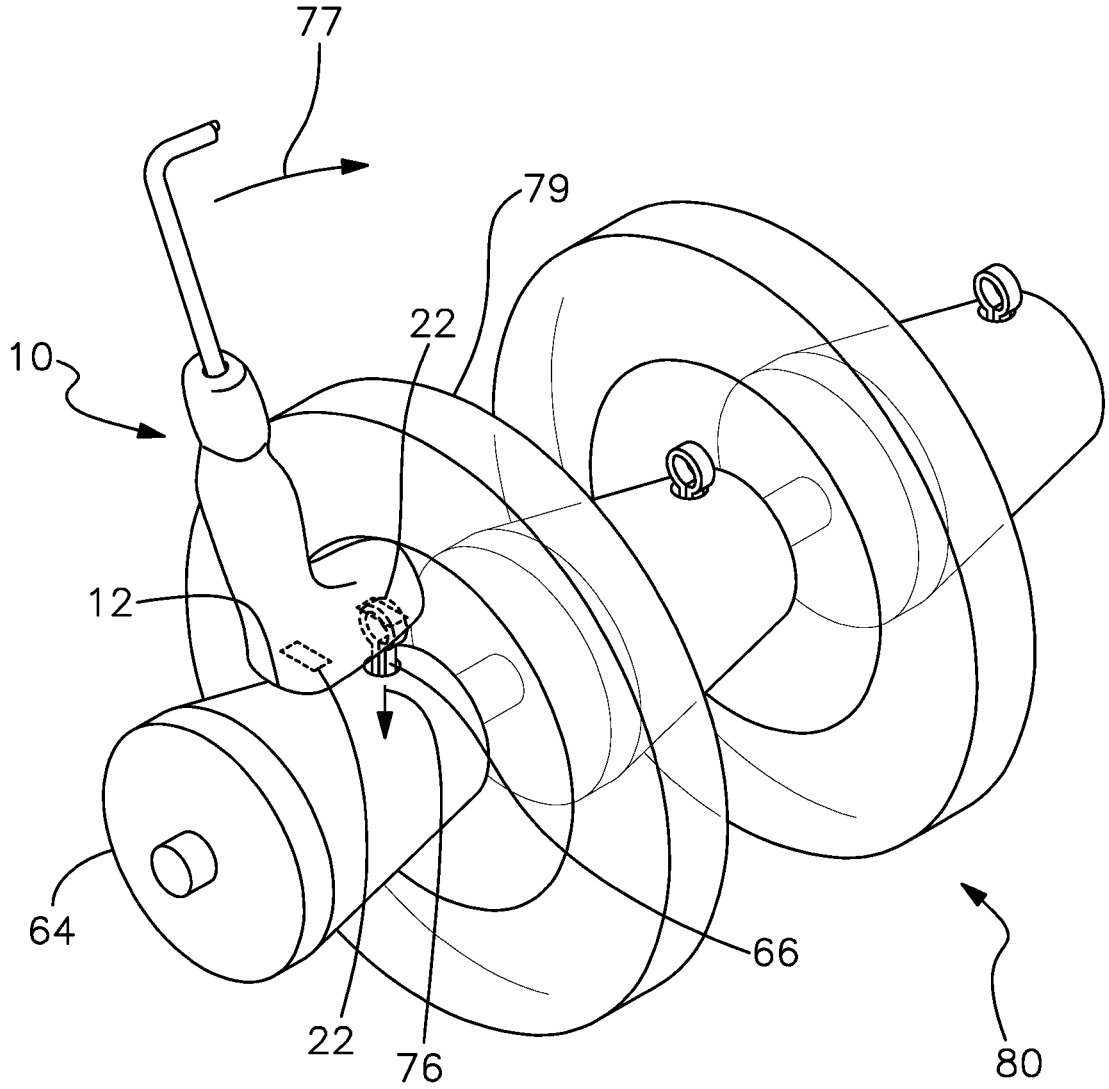
FIG. 8 is a perspective view of the proximal end of the tool inserted into a cotter key showing a method according to a preferred embodiment of the invention.

FIG. 8 shows a method for reinsertion of cotter key 66 using tool 10 of the preferred embodiment of the invention.

In this process, tool 10 is turned with handle butt end 12 positioned against housing 64 with depression 22 placed over the head of cotter key 66. Butt end 12 is configured to fit within a space formed between the insulator glass 75 and housing 64 and over cotter key 66. As the operator pushes tool 10 in forward direction 77 toward the insulation glass, butt end 12 applies pressure as it pivots on housing 64 and pushes cotter key 66 in downward direction 76 back into position to lock housing 64 into adjacent insulator 80.

Two notches 22 are shown for handling insertion of the cotter key and depending on the configuration of the insulator bell and position of the key may be used to reinsert the key.

In operation, tool 10 is used primarily for Transmission Insulation and Hardware (TITH). It is used during the construction phase of power lines and non-energized maintenance. The tool of the present invention is typically not used while lines are energized. The tool is generally used to engage/disengage cotter keys that are found on transmission lines. However, the tool may find a use in many other industries and products, including farm and railroad equipment, where cotter keys are used to hold one housing to another. There are many applications where a cotter key is positioned in such a way as to leverage the tool against a housing and pull up the key using the tool described herein. The tool can be useful in these applications as well and is not limited to the high power transmission line environment.

In operation, the tool 10 thusly disengages the cotter key to allow linemen to repair/replace TITH. This end is inserted into the area where the cotter key is engaged and the hook is inserted into the eye of the cotter key and leverage is applied to disengage the cotter key. Leverage is applied on the curved portion of the main extension against the upper surface of the cap, surrounded by an insulator.

The handle end (butt) of the tool is used to re-engage the cotter key. After the TITH is repaired/replaced this end is inserted into the area where the cotter key is disengaged and the extruded part of the butt is placed on top of the disengaged cotter key and leverage is applied to re-engage the cotter key.

The curved extension has on its distal end a smaller cylindrical knob having its upper tangent coextensive with the upper tangent of the larger cylindrical extension diameter.

With the cotter key pulled out partially, the bell of one can be disengaged from the bell of another in a string.

To reinsert the cotter key, the operator applies force on the head of the cotter key by leveraging the butt end of the tool against the cotter key head to force it back into position to fixedly engage the cotter key such that it provides a blocking position to the inner expanded pin within the cap. The pin is fit within a notch on the inside of a second bell and once engaged the cotter key prevents the pin from being removed from the notch.

In operation, the cotter key may be re-inserted by using pressure from the butt end of the tool and applying pressure at the notch in the handle against the cotter key to provide leverage against the cotter key.

If necessary, the operator may tap on the L-shaped end of the tool with a hammer or other blunt object to create downward pressure on the handle and upon the cotter key. At this point, the cotter key is securely engaged.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the later issued claims.

I claim:

1. A tool for a user to remove or insert cotter keys in insulator bells comprising:

a. an L-shaped body having a first and second portion each axially symmetric, with at least one depression on a generally flat butt end surface of a proximal end of the L-shaped body;

b. a generally cylindrical rigid member extending from the distal portion of the L-shaped body fixedly attached to the body; and c. the generally cylindrical rigid member being L-shaped and terminates at a distal end in a second generally cylindrical tab having a smaller cross section than the cross section of the rigid member.

2. The tool as claimed in claim 1 wherein the cylindrical rigid member has a proximal end that is L-shaped and is fixedly inserted in the body for stable engagement.

3. The tool as claimed in claim 1 wherein the cylindrical member is a right circular cylinder in shape.

4. The tool as claimed in claim 1 wherein central axis of the second cylindrical tab is offset from the axial center of the cylindrical rigid member.

5. The tool as claimed in claim 1 further comprising a second depression in the butt end of the handle.

6. The tool as claimed in claim 1 wherein the second portion of the body is tapered in between the distal end of the body and the first portion of the body.

7. The tool as claimed in claim 1 wherein the L-shaped body is made of pliable material.

8. A tool for a user to remove or insert cotter keys from a housing comprising:

a. an axially symmetric body with at least one depression in a generally flat butt end surface of a proximal end of the body;

b. the body having an extended proximal end with a generally cylindrical cross sectional L-shaped rigid member extending from the distal portion of the body fixedly inserted into a cavity in the body; and c. a tab extended from the distal end of the rigid member having a generally cylindrical cross sectional shape.

9. A tool as claimed in claim 8 further comprising an ergonomically shaped body for gripping by a user.

10. A tool as claimed in claim 8 further comprising a body that is made of plastic.

11. A tool as claimed in claim 8 wherein the rigid member has an L-shaped proximal end fixedly contained within the body.

12. A tool as claimed in claim 8 wherein the body is tapered in the middle.

13. A tool as claimed in claim 8 wherein the body is formed by two symmetrical portions.

14. A tool as claimed in claim 8 wherein in the body and the extension are integrally formed of the same material.

15. A tool as claimed in claim 8 where the body is composed of a pliable material.

16. A tool as claimed in claim 8 where the body is composed of a synthetic material.

17. A method for removing a cotter key from a bell in an insulator string using a tool comprising the steps of:

a. grasping with a hand an L-shaped body having a first and second portion each axially symmetric and a generally cylindrical L-shaped extension distal from the handle;

b. inserting a smaller extension at the distal end of the L-shaped extension into a cotter key in an insulator cap;

c. leveraging a bend in the L-shaped cylindrical extension against an insulator cap;

d. pulling upward the generally cylindrical L-shaped extension having its distal end terminated in a second generally cylindrical shorter portion having a smaller cross section than the cross section of the longer portion of the member while inserted into the cotter key in the insulator cap thereby permitting removal of the cap from an insulator string.

18. The method as claimed in claim 17 further comprising depressing the handle against a cotter key to reinsert the key.

19. The method as claimed in claim 18 further comprising the step of placing a depression in the butt end of the tool against the cotter key.

20. The method as claimed in claim 17 further comprising leveraging a butt end of the handle against the adjacent insulator.

* * * * *